US006637852B2

(12) United States Patent
Bjune

(10) Patent No.: US 6,637,852 B2
(45) Date of Patent: Oct. 28, 2003

(54) METHOD FOR MEDIA HANDLING IN AN IMAGING DEVICE

(75) Inventor: Geir A. Bjune, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 30 days.

(21) Appl. No.: 10/057,702

(22) Filed: Jan. 24, 2002

(65) Prior Publication Data

US 2003/0137548 A1 Jul. 24, 2003

(51) Int. Cl.[7] ..... B65H 7/02
(52) U.S. Cl. ..... 347/16; 271/258.01; 400/708
(58) Field of Search ..... 347/16, 104; 400/708, 400/630, 632; 271/258.01; 399/385, 394, 395, 371

(56) References Cited

U.S. PATENT DOCUMENTS 5,547,299 A * 8/1996 Dusterhus et al. ..... 400/708
5,639,171 A * 6/1997 Brewster, Jr. et al. ..... 400/708
5,730,537 A 3/1998 Kelly et al. ..... 400/625
5,856,833 A 1/1999 Elgee et al. ..... 347/19
5,940,093 A * 8/1999 Bolash et al. ..... 347/16
6,435,641 B1 * 8/2002 Tung et al. ..... 347/16

OTHER PUBLICATIONS

Co–pending, Hewlett–Packard Company, U.S. patent application Ser. No. 09/676,100, filed Sep. 29, 2000, entitled: "Two–Stage MEDI a Determination System for Inkjet Printing".

* cited by examiner

*Primary Examiner*—Craig Hallacher
(74) *Attorney, Agent, or Firm*—Charles F. Moore

(57) ABSTRACT

A method of adjusting the positioning of a media sheet in an imaging device is provided. Data is collected related to the positioning of a media sheet in a plurality of ejection/positioning sequences. The position of a subsequent sheet is adjusted based on the data.

11 Claims, 2 Drawing Sheets

METHOD FOR MEDIA HANDLING IN AN IMAGING DEVICE

TECHNICAL FIELD

The present invention relates generally to media handling in an imaging device and, more particularly, to a method that adjusts a media positioning sequence based on previous positioning sequences.

BACKGROUND

In imaging devices such as inkjet and electrophotographic printers, the typical imaging process includes picking a sheet of media from an input tray, feeding the sheet through an imaging zone and then ejecting the sheet through an output port into an output tray. Where faster throughput is desired, a continuous feed or "head-to-tail" printing mode may be employed. In head-to-tail printing the printer media handling system picks one media sheet after another to create a series sequence of media sheets that move through the imaging zone and are ejected into the output tray. In this mode the trailing edge of a first media sheet is substantially adjacent to the leading edge of a second media sheet that immediately follows the first sheet. In practice, there is a small gap between the media sheets that is used to discriminate between sheets. An edge detector may be used to sense the leading edge of the second sheet and to position the sheet relative to the imaging zone.

In one method of head-to-tail printing, the ejection of a first or leading sheet and the positioning of the second or trailing sheet may occur in one sequence of movements of the media handling system. In some ejection/positioning sequences the trailing sheet may be positioned too far forward or too far away from its optimal position relative to the imaging zone. Where the second sheet is positioned too far forward, before printing may begin the sheet must first be reversed until the edge detector senses the leading edge. Where the second sheet is positioned too far away from the imaging zone, the sheet must first be advanced before printing may begin. These extra movements of the sheet slow printing throughput and may cause media jams and other media handling errors.

A variety of factors may affect the ejection sequence and the positioning of the trailing sheet relative to the imaging zone. For example, the type of media being printed, the print quality mode selected and environmental conditions may affect the ejection sequence and positioning of the trailing sheet. Additionally, the age of the printer and the wear of printer parts, particularly in the media handling mechanisms, can affect the ejection and positioning of the media sheets.

Some prior imaging devices have utilized two or more fixed ejection sequences that are selected based on various characteristics of the print request, such as the type of media being printed, the length of the media, the print speed required, the print quality, etc. One example of a printer that utilizes different ejection sequences is the DeskJet® 970 inkjet printer manufactured by Hewlett-Packard Co. of Palo Alto, Calif. This printer selects between a fast and a slow media ejection speed based on the print quality selected by the user (Best, Normal or Draft). The printer may select the slower ejection speed for the Best and Normal settings where printing speed or throughput is less critical to a user, and the faster speed for Draft print jobs where greater throughput is desired. However, these ejection sequences are fixed and cannot adjust to account for the variety of factors that may affect the ejection sequence and the positioning of media sheets.

Thus, a need exists for an improved method for positioning media that addresses the limitations of the prior art.

BRIEF DESCRIPTION OF THE SEVERAL VIEWS OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE INVENTION

Figure 1:
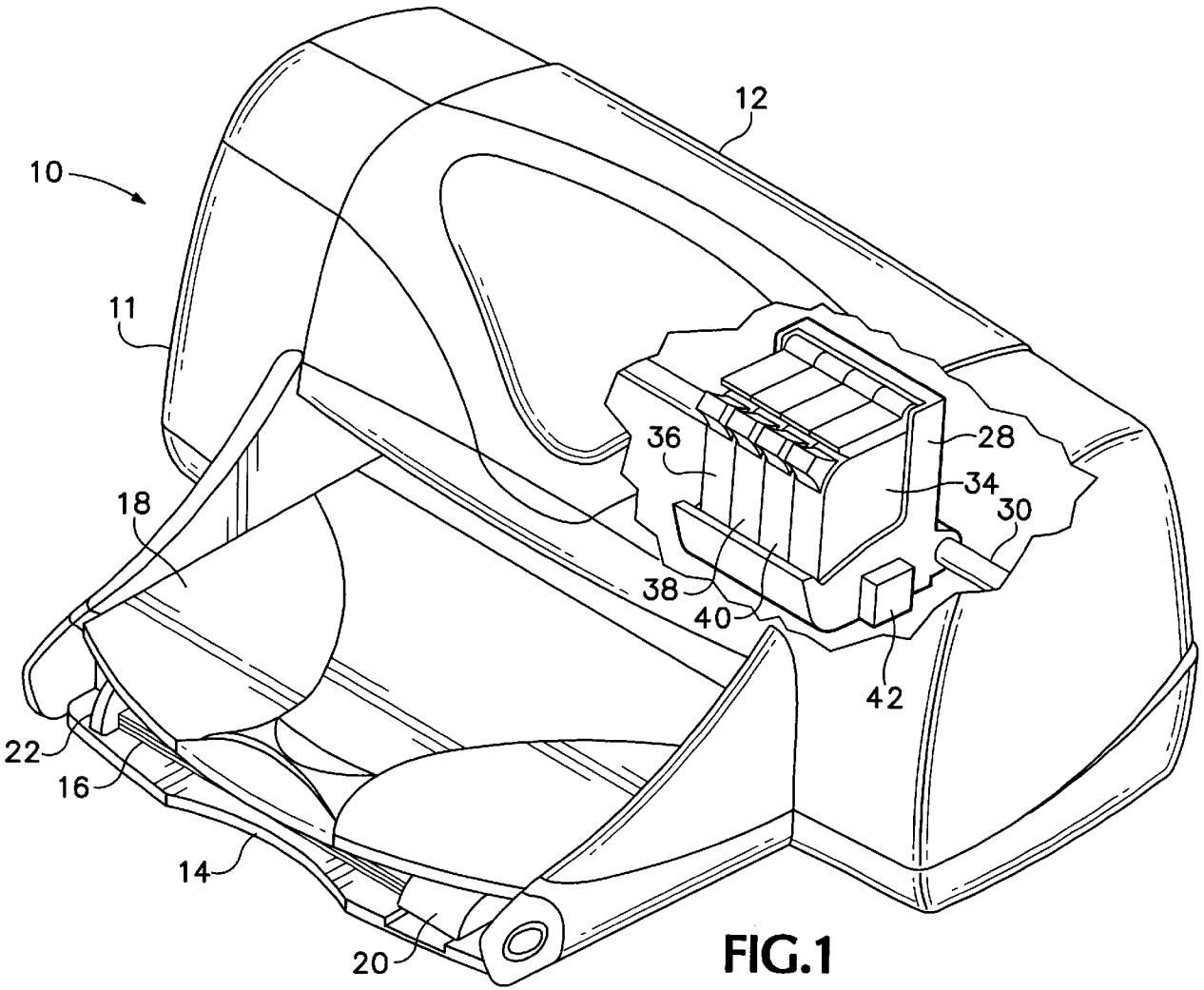
FIG. 1 is a perspective view of an inkjet printer that utilizes the method of the present invention.

FIG. 1 illustrates an embodiment of an inkjet printing device 10 that utilizes the method of the present invention. It will be appreciated that the present invention may be practiced with various other imaging devices that include a media ejection sequence in their media handling process. Such imaging devices may include printers using other marking technologies, such as electrophotographic, thermal transfer, and dye sublimation printers, plotters, portable printing units, copiers, scanners, facsimile machines, as well as various combinations of these and other devices. To facilitate description, the concepts of the present invention are described in the environment of an inkjet printing device 10.

The inkjet printing device 10 includes a housing 11 and a lid 12 shown in a closed position. A media tray 14 holds sheets of print media 16 that are fed into the printer 10 by a media transport system (not shown), as known to one of skill in the art. A more detailed description of an exemplary media transport system is provided in U.S. Pat. No. 5,730,537 (hereinafter "the '537 patent"). U.S. Pat. No. 5,730,537 is specifically incorporated by reference in its entirety. The printer 10 includes a controller (not shown) that receives instructions from a host device such as a personal computer. The controller includes logic that distributes control signals and generally controls the operation of the printer 10 and its various components and subsystems, as known to one of skill in the art.

The print media may be any type of suitable sheet material, such as various sizes of plain paper, coated paper, card-stock, envelopes, transparencies and the like. The media tray 14 may include one or more adjustment mechanisms for accommodating different sizes of print media, such as a sliding length adjustment lever 20 and a sliding width adjustment lever 22. An output tray 18 receives sheets of printed media produced by the printer 10.

With continued reference to FIG. 1, the lid 12 of the printer 10 is shown with a cutaway portion to reveal a carriage 28. The carriage 28 is slidably mounted on a guide rod 30 for reciprocating motion over the print media. The carriage 28 holds a black inkjet pen 34 and three color inkjet pens 36, 38 and 40. The color pens 36, 38 and 40 may include three colors of ink, such as cyan, yellow and magenta. Each of the inkjet pens 34, 36, 38 and 40 includes a printhead having an array of orifices through which droplets of ink are expelled onto the surface of the media to generate an image. More specifically, the ink is expelled from one or both pens 34, 36 as the carriage 28 moves laterally over a print zone 44 in an x-axis direction. Between carriage scans the media is advanced by the media transport system in a y-axis direction that is perpendicular to the carriage scan x-axis direction. In this manner, an image may be generated in a raster fashion by building up the image line by line. When printing on the media is completed, the media is ejected by the media transport system into the output tray 18.

With continued reference to FIG. 1, an optical emitter/sensor module 42 may also be mounted to the carriage 28. As is known in the art, the optical emitter/sensor module 42 may be utilized to perform various printer calibration and positioning operations, such as image registration and line-feed adjustments, and to determine media size and/or type. A typical emitter/sensor module includes one or more light sources, such as Light Emitting Diode (LED) lamps, a photodetector and a lens element. Typically, the emitter/sensor module is propelled back and forth across a media sheet as an LED illuminates a selected region of the sheet. The lens element focuses light from the illuminated region onto the photodetector. As the module scans across the sheet and over a printed pattern or edge of the sheet, the photodetector records variations in collected light flux. Printer electronics calculate the location of the printed pattern or sheet edge by coordinating with an electronic signal from a motion encoder that records the position of the module relative to the printer. A more detailed description of an optical emitter/sensor and its operation in an inkjet printer is provided in U.S. Pat. No. 5,856,833. A more detailed description of the operation of an optical emitter/sensor to determine media type and other media characteristics is provided in pending U.S. application Ser. No. 09/676,100, filed on Sep. 29, 2000. U.S. Pat, No. 5,856,833 and U.S. application Ser. No. 09/676,100 are both specifically incorporated by reference in their entirety.

Figure 2:
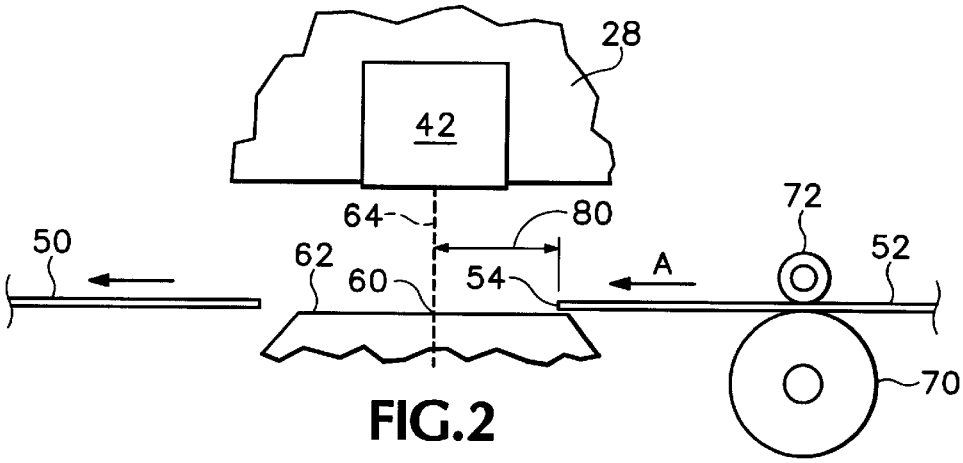
FIG. 2 is a schematic illustration of the imaging zone in the printer of FIG. 1 showing a first media sheet being ejected and a second media sheet being positioned behind a sensing location.

With reference to FIG. 2, one embodiment of the method of the present invention will now be described. FIG. 2 shows a first sheet 50 being ejected by the media transport system and a second sheet 52 being positioned behind a sensing location 60 on a support surface 62. A drive roller 70 and an idler roller 72 form a nip through which the first sheet 50 and second sheet 52 travel. As the first sheet 50 is ejected, the second sheet 52 is positioned for printing relative to the sensing location 60. The optical emitter/sensor module 42 mounted to the carriage 28 is shown directing a light beam 64 onto the sensing location 60.

Figure 5:
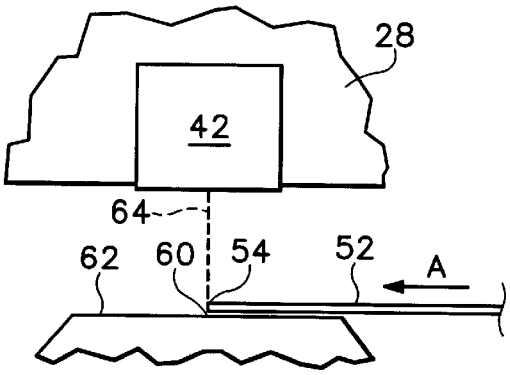
FIG. 5 is a schematic illustration showing the second media sheet being advanced to the sensing location.

Prior to printing the second sheet 52, the printer 10 determines the location of the leading edge 54 of the second sheet 52. To locate the leading edge 54, the printer 10 first determines whether the second sheet 52 is positioned beyond or behind the sensing location 60. The optical emitter/sensor module 42 emits light beam 64 and either senses the presence of the second sheet 52 or does not sense the presence of the sheet. FIG. 2 shows an example in which the leading edge 54 of the second sheet 52 is positioned behind the sensing location 60 by a first distance 80. In this situation, the optical emitter/sensor module 42 does not sense the second sheet 52 at the sensing location 60. To locate the leading edge 54 in this situation, the second sheet 52 is advanced in the direction of action arrow A until the light beam 64 is interrupted by the leading edge of the sheet (FIG. 5). When the light beam 64 is interrupted, the second sheet 52 is then reversed to position it slightly behind the sensing location 60 and ready for printing. In one aspect of the method of the present invention, data is collected relative to the first distance 80 that the second sheet 52 is advanced before the light beam 64 is interrupted.

Figure 3:
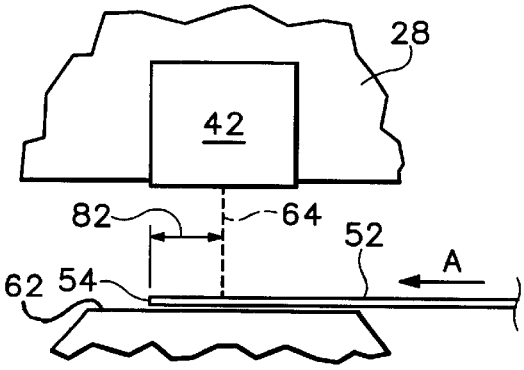
FIG. 3 is a schematic illustration of the imaging zone in the printer of FIG. 1 showing a second media sheet being positioned beyond a sensing location.
Figure 4:
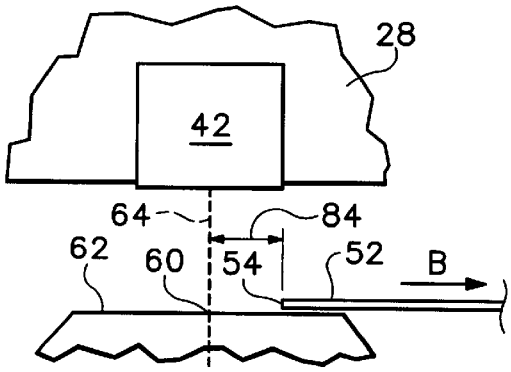
FIG. 4 is a schematic illustration showing the second media sheet being reversed to be positioned behind the sensing location.

With reference now to FIG. 3, in another situation the second sheet 52 may be positioned beyond the sensing location 60 by a second distance 82 after the first sheet 50 has been ejected. In this situation, the optical emitter/sensor module 42 senses the second sheet 52 at the sensing location 60. As shown in FIG. 4, to locate the leading edge 54 in this situation, the second sheet 52 is reversed in the direction of action arrow B until the light beam 64 senses the support surface 62. In one aspect of the method of the present invention, data is collected relative to the second distance 82 that the second sheet 52 is reversed before the light beam 64 senses the support surface 62. When the light beam 64 senses the support surface 62, the second sheet 52 is reversed a short distance 84 behind the sensing location 60 and the process for locating the leading edge 54 of the sheet is performed as described above. If the light beam 64 still senses the second sheet 52 after the sheet has been reversed by a threshold distance, such as 2 cm., then it is likely that there is a media feed error, such as a media jam or a muti-pick where two or more sheets are overlapping. In this situation, the second sheet 52 may be ejected and a new media pick operation may be performed.

It will be appreciated that the above-described processes for locating the leading edge 54 of the second sheet 52 can slow the throughput of the printer 10. Additionally, advancing and reversing the second sheet 52 can lead to media jams, skewed media and other media-related errors. Preferably, the second sheet 52 will be positioned slightly behind the sensing location 60 after the first sheet 50 is ejected, thereby minimizing the movements and distances required to locate the leading edge 54.

In one embodiment of the method of the present invention, the data that is collected related to whether the second sheet 52 was reversed or advanced is analyzed over a plurality of ejection/positioning sequences to determine whether a pattern exists. For example, data may be collected over n ejection/positioning sequences, where n is an integer greater than one. Preferably, the data is stored in non-volatile random access memory (NVRAM) in the printer 10. Based on this data, the position of a subsequent sheet is adjusted relative to the sensing location to more accurately position the subsequent sheet relative to the sensing location.

In one example of the operation of the invention, one pattern that may be identified comprises each of the n ejection/positioning sequences including advancing the second sheet 52. For example, where n=5, the five ejection positioning sequences could result in the second sheet 52 being advanced by distances of 2.0 mm, 3.0 mm, 4.0 mm, 5.0 mm and 6.0 mm. Because in each case the second sheet 52 was positioned behind the sensing location 60 and needed to be advanced, the present method may adjust the operation of the media transport system to position a subsequent sheet closer to the sensing location 60. More specifically, in one embodiment the media transport system may be adjusted to position a subsequent sheet closer to the sensing location by a distance corresponding to the shortest distance that the second sheet 52 was advanced in each of the five ejection/ positioning sequences. In the above example, the adjustment would comprise positioning the subsequent sheet 2.0 mm closer to the sensing location 60, or advancing the sheet 2.0 mm farther from the nip of the drive roller 70/idler roller 72.

In another example of the operation of the invention, another pattern that may be identified comprises each of the n ejection/positioning sequences including reversing the second sheet 52. For example, where n=5, the five ejection positioning sequences could result in the second sheet 52 being reversed by distances of 2.0 mm, 3.0 mm, 4.0 mm, 5.0 mm and 6.0 mm. Because in each case the second sheet 52 was positioned beyond the sensing location 60 and needed to be reversed, the present method may adjust the operation of the media transport system to position a subsequent sheet closer to the sensing location 60. More specifically, in one embodiment the media transport system may be adjusted to position a subsequent sheet closer to the sensing location by a distance corresponding to the shortest distance that the second sheet 52 was reversed in each of the five ejection/positioning sequences. In the above example, the adjustment would comprise positioning the subsequent sheet 2.0 mm closer to the sensing location 60, or advancing the sheet 2.0 mm less from the nip of the drive roller 70/idler roller 72.

Advantageously, the present method allows the printer to monitor ejection/positioning sequences and to adjust subsequent sequences to account for previous sub-optimal positioning. By adjusting ejection/positioning sequences for more accurate positioning of the second sheet 52, printer throughput is maximized and media-related errors are reduced. Additionally, the present method automatically corrects for media transport system variations between individual printers, thereby improving printer reliability and creating consistent performance among the printers.

Many variations and modifications may be made to the above-described embodiment(s) of the invention without departing substantially from the spirit and principles of the invention. All such modifications and variations are intended to be included herein within the scope of the present invention.

What is claimed is:

1. A method of positioning a sheet in an imaging device comprising:

A. ejecting a sheet and positioning an additional sheet relative to a sensing location;

B. either sensing the additional sheet or not sensing the additional sheet at the sensing location;

C. if the additional sheet is sensed, reversing the additional sheet until the additional sheet is not sensed;

D. if the additional sheet is not sensed, advancing the additional sheet until the additional sheet is sensed;

E. collecting data related to the advancing or reversing of the additional sheet; repeating steps (A) through (E) a plurality of times; and adjusting a position of a subsequent sheet relative to the sensing location based on the data.

2. The method of claim 1, wherein the step of sensing the additional sheet comprises using an optical sensor to determine a presence or absence of the additional sheet at the sensing location.

3. The method of claim 1, further including the step of analyzing the data to determine whether a pattern exists in the plurality of executions of the steps (A) through (E).

4. The method of claim 3, wherein the pattern comprises each of the executions of the steps (A) through (E) including advancing the second sheet.

5. The method of claim 4, wherein the step of adjusting an ejection of a subsequent sheet further includes positioning the subsequent sheet closer to the sensing location than the additional sheet was positioned relative to the sensing location.

6. The method of claim 5, further including the step of positioning the subsequent sheet closer to the sensing location by a distance corresponding to a shortest distance that the additional sheet was advanced in each of the plurality of executions of steps (A) through (E).

7. The method of claim 3, wherein the pattern comprises each of the plurality of executions of the steps (A) through (E) including reversing the additional sheet.

8. The method of claim 7, wherein the step of adjusting an ejection of a subsequent sheet further includes positioning the subsequent sheet closer to the sensing location than the additional sheet was positioned relative to the sensing location.

9. The method of claim 8, further including the step of positioning the subsequent sheet closer to the sensing location by a distance corresponding to a shortest distance that the additional sheet was reversed in each of the plurality of executions of steps (A) through (E).

10. The method of claim 1, wherein the step of reversing the additional sheet until the additional sheet is not sensed further comprises ejecting the additional sheet if the additional sheet is still sensed after reversing the second sheet by a threshold distance.

11. The method of claim 1, further including the step of storing the data in NVRAM in the imaging device.

* * * * *